United States Patent [19]

Amos

[11] Patent Number: 4,519,516

[45] Date of Patent: May 28, 1985

[54] TAMPER INDICATING PACKAGE

[75] Inventor: Charles W. Amos, Bowling Green, Ohio

[73] Assignee: Owens-Illinois, Inc., Toledo, Ohio

[21] Appl. No.: 573,985

[22] Filed: Jan. 26, 1984

[51] Int. Cl.[3] ..... B65D 41/34

[52] U.S. Cl. ..... 215/252; 215/274

[58] Field of Search ..... 215/252, 274; 220/319

[56] References Cited

U.S. PATENT DOCUMENTS

| | | | |
|---|---|---|---|
| 1,311,419 | 7/1919 | Russell | 215/274 |
| 1,908,245 | 5/1933 | Hogg | 215/252 |
| 2,444,506 | 7/1948 | Hammer | 215/253 X |
| 3,464,576 | 9/1969 | Rohde | 215/252 |
| 3,910,443 | 10/1975 | Hadley | 215/252 |
| 4,458,821 | 7/1984 | Ostrowsky | 215/252 |

FOREIGN PATENT DOCUMENTS

| | | | |
|---|---|---|---|
| 404496 | 1/1934 | United Kingdom | 215/274 |

*Primary Examiner*—Donald F. Norton

*Attorney, Agent, or Firm*—John R. Nelson

[57] ABSTRACT

A tamper indicating package comprising a container having a neck with external threads thereon, a radial bead beneath the threads, and a closure having a base wall and a peripheral wall with internal threads on the peripheral wall complementary to the threads on the container. The closure having a radially extending lip at the free end of the peripheral skirt. A tamper indicating band comprises a continuous annular wall, an upper radially inwardly extending flange for engaging the lip on the closure, and a lower generally radially inwardly and upwardly extending flange for engaging the flange on the container. The lower flange is discontinuous such that the tamper indicating band can be applied to the closure and container after the closure has been applied to the container by moving the band axially downwardly and causing the lower flange to flex radially outwardly and then snap radially inwardly beneath the flange of the container. The tampering indicating band includes weakened portions such that when the closure is rotated to remove the closure from the container, the lift force of the threads causes the band to be severed.

8 Claims, 7 Drawing Figures

TAMPER INDICATING PACKAGE

This invention relates to tamper indicating packages.

BACKGROUND AND SUMMARY OF THE INVENTION

In order to insure the safety of users of various products, it has become important to provide some indication of whether or not the package has been tampered with. One type of tamper indicating device that has been utilized in connection with containers having threaded necks and a radial bead below the threads, wherein a closure is threaded on the threads of the container, is to provide a band that interengages the closure and the bead of the container. For example, in U.S. Pat. No. 3,464,576 a discontinuous band made of one or more portions is provided, the portions being bonded to one another. Vertical weakened lines are provided in the band so that it can be torn and when it is torn and removed it will be evident that the band has been removed. In another type of device, the band is mechanically interconnected to the closure as shown in U.S. Pat. No. 2,444,506.

Accordingly, among the objectives of the present invention are to provide a tamper indicating device which will effectively provide an indication of whether the contents of the container have been tampered with; which can be applied to existing closures and containers without modification of either; which does not require separate operations but is applied merely by moving axially over the closure after the closure has been applied to the container.

In accordance with the invention, the tamper indicating package comprises a container having a neck with external threads thereon, a radial bead beneath the threads, and a closure having a top wall and a peripheral skirt with internal threads on the peripheral skirt complementary to the threads on the container. The closure has a radially extending lip at the free end of the peripheral skirt. A tamper indicating band is provided and comprises a continuous annular wall, an upper radially inwardly extending flange for engaging the lip on the closure, and a lower generally radially inwardly and upwardly extending flange for engaging the flange on the container. The lower flange is discontinuous such that the tamper indicating band can be applied to the closure and container after the closure has been applied to the container by moving the band axially inwardly and causing the lower flange to flex radially outwardly and then snap radially inwardly beneath the flange of the container. The tamper indicating band includes weakened portions such that when the closure is rotated to remove the closure from the container, the lift force of the threads causes the band to be severed.

DESCRIPTION

Figure 1:
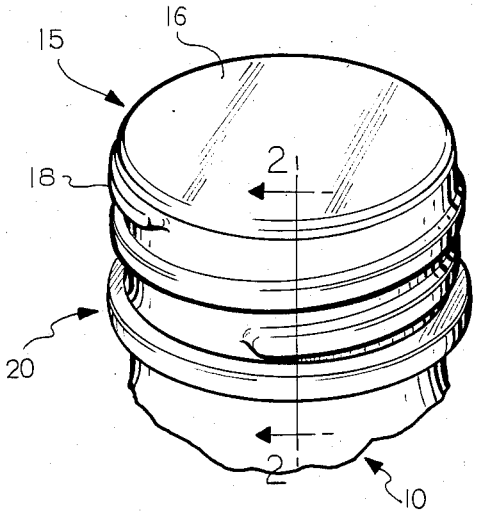
FIG. 1 is a fragmentary perspective view of a tamper indicating package embodying the invention.

Referring to FIGS. 1–4, the tamper indicating package embodying the invention comprises a container 10 which may be made of glass or plastic and has a neck 11 with external threads 12 and a radial flange or bead 13 below the threads 12. A closure 15 made of various materials such as metal or plastic includes a base or top wall 16 and a peripheral skirt 17 with threads 18 formed in the skirt 17 that engage the threads 12 of the container 10. The closure 15 includes a radial flange 19 at the lower free edge of the skirt which in the case of metal is a rolled bead. The construction of the container and closure are conventional and well known.

In accordance with the invention, the tamper indicating device comprises a continuous annular band 20 made of a material that will flex such as metal or plastic and comprising an axial vertical wall 21, an annular upper lip 22 extending radially inwardly and an annular lower lip 23 extending radially inwardly and axially upwardly. The band 20 is provided with a weakened portion by a continuous or discontinuous groove 24 that forms thin portions in the wall. The lower lip 23 is formed with circumferentially spaced radial slits 25 so that it will more readily flex as presently described.

After the closure 15 has been applied to the container 10, the band 20 is placed over the closure 15 and moved axially downwardly causing the segments of the lower lip 23 to flex radially outwardly over the bead 13 and thereafter snap radially beneath the bead 13. Thus, the band 20 provides an indication when it is present that the contents have not been tampered with.

Figure 2:
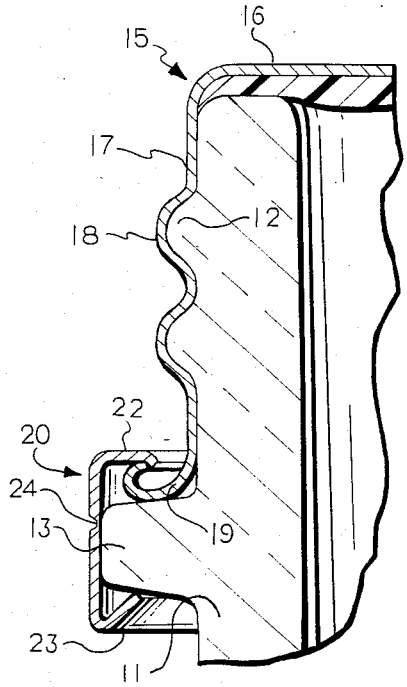
FIG. 2 is a fragmentary sectional view taken along the line 2—2 in FIG. 1.
Figure 3:
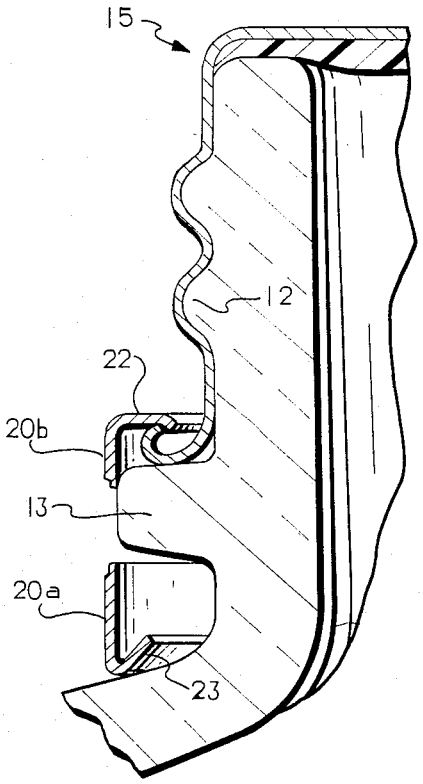
FIG. 3 is a fragmentary sectional view similar to FIG. 2 showing the relative position of the parts after the tamper indicating band has been broken.
Figure 7:
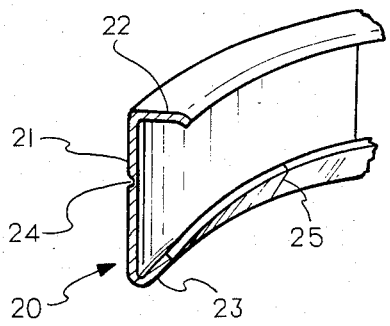
FIG. 7 is a fragmentary sectional perspective view taken generally along the line 7—7 in FIG. 4.
Figure 4:
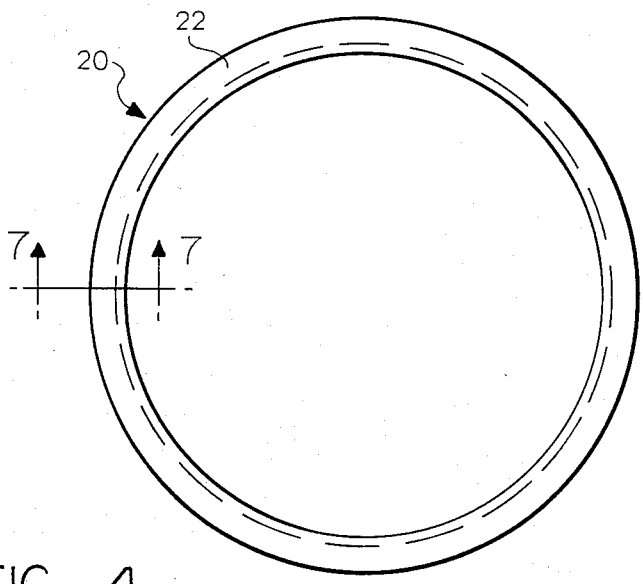
FIG. 4 is a top plan view of the tamper indicating band.
Figure 5:
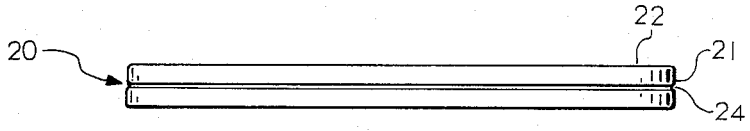
FIG. 5 is a side elevational view of the tamper indicating band.
Figure 6:
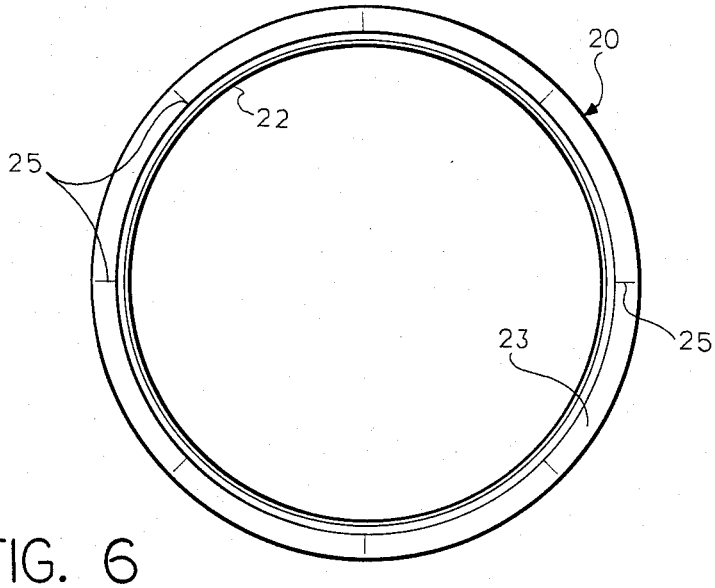
FIG. 6 is a bottom plan view of the tamper indicating band.

When the closure 15 is rotated to remove the closure from the container, the force resisting the rotation by the presence of the band 20 places a force on the band 20 that causes the band 20 to be severed into two parts, the lower part 20*a* staying with the container and the upper part 20*b* being removed with the closure, as shown in FIG. 2.

I claim:

1. A tamper indicating package comprising a container having a neck with external threads thereon, a radial flange beneath the threads, a closure having a top wall and a peripheral skirt with internal threads on the peripheral skirt complementary to the threads on the container, said closure having a radially extending lip at the free end of the peripheral skirt, and a tamper indicating band comprising a continuous annular wall, an upper radially inwardly extending flange for engaging the lip on the closure, and a lower generally radially inwardly and upwardly extending flange for engaging the flange on the container, said lower flange being discontinuous such that the tamper indicating band can be applied to the closure and container after the closure has been applied to the container by moving the band axially downwardly and causing the lower flange to flex radially outwardly and then snap radially inwardly beneath the flange of the container, said tamper indicating band including weakened portions such that when the closure is rotated to remove the closure from the container, the lift force of the threads causes the band to be severed.

2. The tamper indicating package set forth in claim 1 wherein said weakened portions comprise horizontally extending portions which are of less radial thickness.

3. The tamper indicating package set forth in claim 1 wherein said discontinuous lower flange is provided by radial slits in said lower flange.

4. The tamper indicating package as set forth in claim 1 wherein said band is made of metal.

5. A tamper indicating band adapted to be applied to a container having a neck with external threads thereon, a radial bead beneath the threads, and a closure having a top wall and a peripheral wall with internal threads on the peripheral skirt complementary to the threads on the container, said closure has a radially extending lip at the free end of the peripheral skirt, said tamper indicating band comprising a continuous annular wall, an upper radially inwardly extending flange for engaging the lip on the closure, and a lower generally radially inwardly and upwardly extending flange for engaging the flange on the container, said lower flange being discontinuous such that the tamper indicating band can be applied to the closure and container after the closure has been applied to the container by moving the band axially downwardly and causing the lower flange to flex radially outwardly and then snap radially inwardly beneath the flange of the container, said tamper indicating band including weakened portions such that when the closure is rotated to remove the closure from the container, the lift force of the threads causes the band to be severed.

6. The tamper indicating band set forth in claim 5 wherein said weakened portions comprise horizontally extending portions which are of less radial thickness.

7. The tamper indicating band set forth in claim 5 wherein said discontinuous lower flange is provided by radial slits in said lower flange.

8. The tamper indicating band set forth in claim 5 wherein said band is made of metal.

* * * * *